US007673850B2

(12) United States Patent
John

(10) Patent No.: US 7,673,850 B2
(45) Date of Patent: Mar. 9, 2010

(54) SAFETY GUARD FOR ELEVATOR MACHINE

(76) Inventor: Telford John, 1390 Wecher Drive, Oshawa, ON (CA) L1J 3P9

( * ) Notice: Subject to any disclaimer, the term of this patent is extended or adjusted under 35 U.S.C. 154(b) by 386 days.

(21) Appl. No.: 11/802,994

(22) Filed: May 29, 2007

(65) Prior Publication Data

US 2008/0000725 A1 Jan. 3, 2008

Related U.S. Application Data

(60) Provisional application No. 60/809,392, filed on May 31, 2006.

(51) Int. Cl.
*B66D 3/06* (2006.01)

(52) U.S. Cl. ..... 254/402

(58) Field of Classification Search ..... 254/401, 254/402, 403, 405, 406
See application file for complete search history.

(56) References Cited

U.S. PATENT DOCUMENTS 1,633,537 A * 6/1927 McKissick ..... 254/402
1,650,903 A * 11/1927 McKissick ..... 254/402
RE17,211 E * 2/1929 McKissick ..... 254/402
1,753,084 A * 4/1930 Kappel ..... 254/405
1,933,011 A * 10/1933 Greve ..... 254/402
2,728,552 A * 12/1955 Fate, Jr. ..... 254/402
2,778,602 A * 1/1957 Fate, Jr. ..... 254/401
4,871,165 A * 10/1989 Marshall et al. ..... 482/116
5,249,543 A * 10/1993 Rutgerson et al. ..... 114/108
5,277,276 A * 1/1994 Pramanik et al. ..... 187/411
6,386,516 B1 * 5/2002 Lenders ..... 254/393

* cited by examiner

*Primary Examiner*—Emmanuel M Marcelo

(57) ABSTRACT

A safety guard apparatus for an elevator machine having a brake and a sheave for engaging one or more hoist ropes rotatably driven by the elevator machine, the safety guard apparatus consisting of a sheave guard including a front sheave wall, a back sheave wall and a pair of oppositely disposed side sheave walls defining a generally rectangular structure adapted for substantially enclosing the sheave of the elevator machine, and a cover guard releasably secured to the sheave guard and including a front cover wall, a back cover wall and a top cover wall through which the one or more hoist ropes and the sheave can be viewed. The safety guard apparatus further including a hoist rope guard releaseably secured to at least one of the pair of oppositely disposed side sheave walls of the sheave guard, wherein the hoist rope guard including a lower portion pivotally coupled to a upper portion for substantially enclosing the one or more hoist ropes extending from the sheave.

14 Claims, 12 Drawing Sheets

PRIOR ART 10
26
84
76
78
90
42
14
66
64
68
103
64
14
94
102
28
90
110
96
92
110
90
98
100
98
36
62
60
62
54
56
46
60
-40-
20
48
68
70
60
-32-
24
112
116
90
90
30
38
34
82
80
68
44
90
78
26
84
76

SAFETY GUARD FOR ELEVATOR MACHINE

FIELD OF THE INVENTION

The present invention relates to a safety guard for machinery, and more particularly to a safety guard for an elevator machine.

BACKGROUND OF THE INVENTION

A wide variety of elevator machines, including traction and pneumatic machinery, may be employed to cause an elevator car to ascend and descend within an elevator shaft. Commonly, an elevator machine includes a grooved sheave which drivingly engages a plurality of hoist ropes attached at a first end to the elevator car and at a second end to a counterweight. The traction or friction between the sheave and the hoist ropes causes the elevator car to ascend and descend in the elevator shaft when an electric motor coupled to the sheave is activated. When in use, the frictional and rotational engagement of the hoist ropes within the grooved sheave creates dangerous nip points into which individuals may become entangled. In order to minimize the risk of entanglement, elevator machines are commonly located in a separate machine room proximate to the elevator shaft. Nevertheless, the unguarded state of the elevator machine within these machine rooms can still pose a significant risk of injury to individuals having access to the room, including elevator service personnel, emergency personnel, and caretakers. Although considerable advancements have been made to ensure the safety of the individuals traveling within the elevator car, few advances have been made to improve the safety conditions for elevator service personnel and other individuals having access to the elevator machine.

Accordingly, there is a need for a safety guard apparatus for an elevator machine which is adapted to enclose the mechanical components of the elevator machine. There is also a need for a safety guard for an elevator machine which enables an individual to observe the operation and condition of the elevator machine without the risk of entanglement. There is a further need for a safety guard apparatus for an elevator machine which is adapted to enable an individual to selectively access one or more components of the elevator machine which require servicing while concealing other one or more components of the elevator machine which do not require servicing or which pose a hazard to the individual.

SUMMARY OF THE INVENTION

The subject invention is directed to a safety guard apparatus for an elevator machine having a brake and a sheave for engaging one or more hoist ropes rotatably driven by the elevator machine. The safety guard apparatus comprises a sheave guard including a front sheave wall, a back sheave wall and a pair of oppositely disposed side sheave walls defining a generally rectangular structure adapted for substantially enclosing the sheave of the elevator machine, and a cover guard releasably secured to the sheave guard and including a front cover wall, a back cover wall and a top cover wall through which the one or more hoist ropes and the sheave can be viewed. The cover guard is coupled to the sheave guard for opening and providing access to the one or more hoist ropes and at least a portion of the sheave.

The front sheave wall, the back sheave wall and the pair of oppositely disposed side sheave walls defining a top sheave flange. The front sheave wall, the back sheave wall and the pair of oppositely disposed side sheave walls defining an interior space. Each of the pair of oppositely disposed side sheave walls including a safety flange extending interiorly towards the sheave. The front cover wall, back cover wall and top cover wall defining a bottom cover flange. The bottom cover flange of the cover guard is releasably secured to the top sheave flange of the sheave guard with one or more fasteners.

The subject invention is further directed to a hoist rope guard releaseably secured to at least one of the pair of oppositely disposed side sheave walls of the sheave guard, wherein the hoist rope guard including a lower portion pivotally coupled to a upper portion for substantially enclosing the one or more hoist ropes extending from the sheave. The first and second rope guard portions together defining a top hoist rope wall and a pair of oppositely disposed side hoist rope walls through which the one or more hoist ropes can be viewed. The lower portion is adaptable for pivotally opening relative to the upper portion for providing access to the one or more hoist ropes. The upper portion is adaptable for pivotally opening relative to the lower portion for providing access to the one or more hoist ropes. At least a portion of the lower portion and the upper portion of the hoist rope guard is manufactured from a perforated sheet material through which the one or more hoist ropes can be viewed. Preferably, the perforated sheet material is a steel material. At least a portion of the lower portion and the upper portion of the hoist rope guard may be manufactured from a transparent material through which the one or more hoist ropes can be viewed.

The subject invention is further directed to a brake guard including a front brake wall, and a side brake wall extending from the front brake wall for substantially enclosing the brake of the elevator machine. At least a portion of the brake guard is manufactured from a perforated sheet material through which the brake can be viewed. Preferably, at least a portion of the perforated sheet material is metal.

BRIEF DESCRIPTION OF THE DRAWINGS

For a better understanding of the present invention, and to show more clearly how it may be carried into effect, reference will now be made, by way of example, to the accompanying drawings, in which.

DETAILED DESCRIPTION OF THE INVENTION

Reference is now made to FIGS. 3, 4, 5 and 6 which illustrate the safety guard apparatus 10 provided on the elevator machine 12 made in accordance with a preferred embodiment of the present invention. The safety guard apparatus 10 is designed to enable elevator service personnel to perform routine maintenance on the elevator machine 12 without accidentally contacting or becoming entangled within the moving components of the elevator machine 12.

Figure 1:
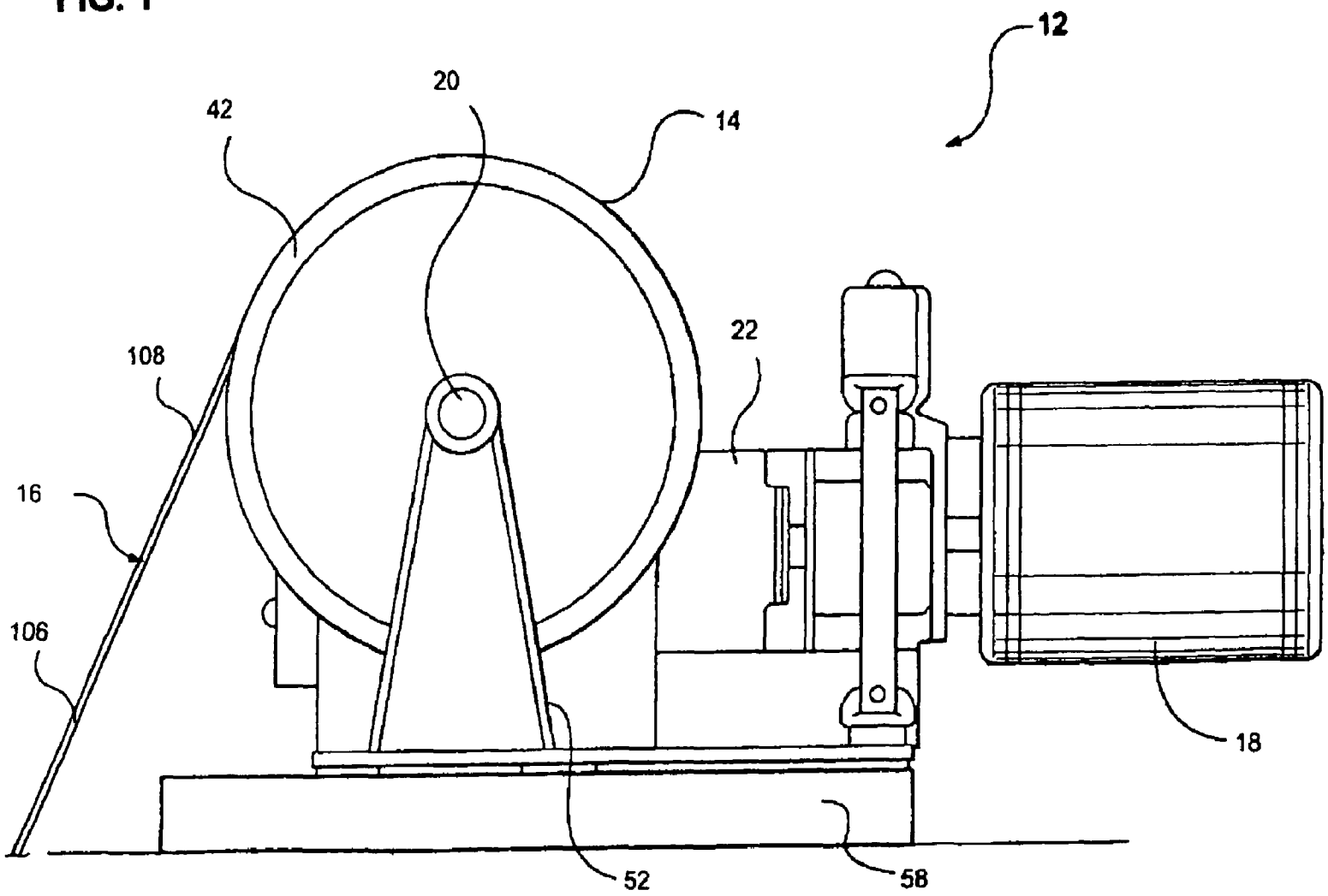
FIG. 1 is a front perspective view of a common prior art elevator machine.
Figure 2:
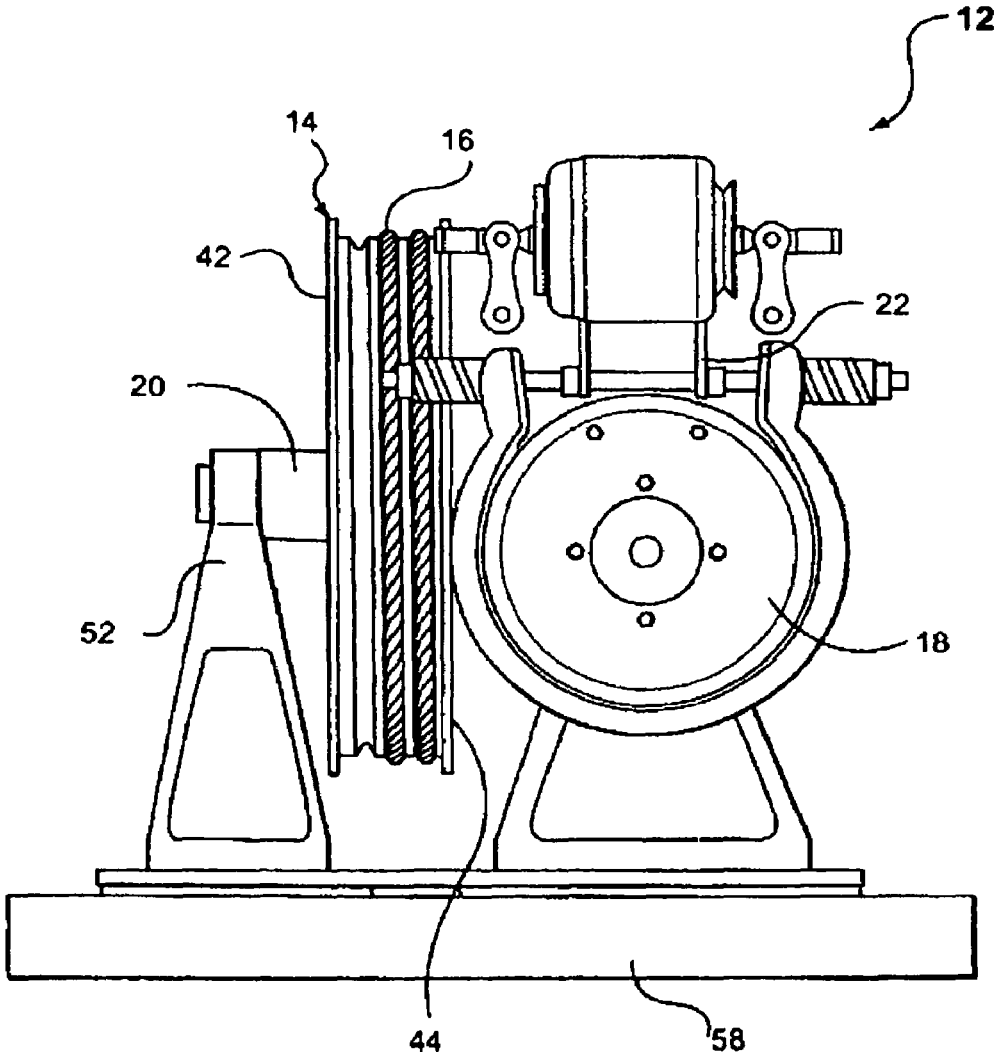
PRIOR ART FIG. 2
FIG. 2 is a side perspective view of the common prior art elevator machine of FIG. 1.

In a common elevator application, an elevator car is caused to ascend and descend within an elevator shaft as a result of the action of an elevator machine 12. Referring to FIGS. 1 and 2, the elevator machine 12 typically comprises a variety of moving mechanical components including a sheave 14 which drivingly engages with a plurality of hoist ropes 16, a motor 18 for rotatably driving the sheave 14 about an axle 20, and a machine brake 22 for controlling the motor 18. The plurality of hoist ropes 16 are attached at a first end to the elevator car and at a second end to a counterweight (not shown). The elevator car is caused to ascend and descend within the elevator shaft as a result of the action of the motor 18. As will be recognized by those skilled in the art, the elevator machine 12 illustrated in FIGS. 1 and 2 and the various components comprising the same are meant to depict a general embodiment of such elevator machine 12 and is not meant in anyway to limit the scope of the invention. During the operation of the elevator machine 12, the rotational movement of the sheave 14 and the engagement of the plurality of hoist ropes 16 about the sheave 14 presents a risk to service personnel or other individuals of becoming entangled or injured by the mechanical components of the elevator machine 12.

Figure 3:
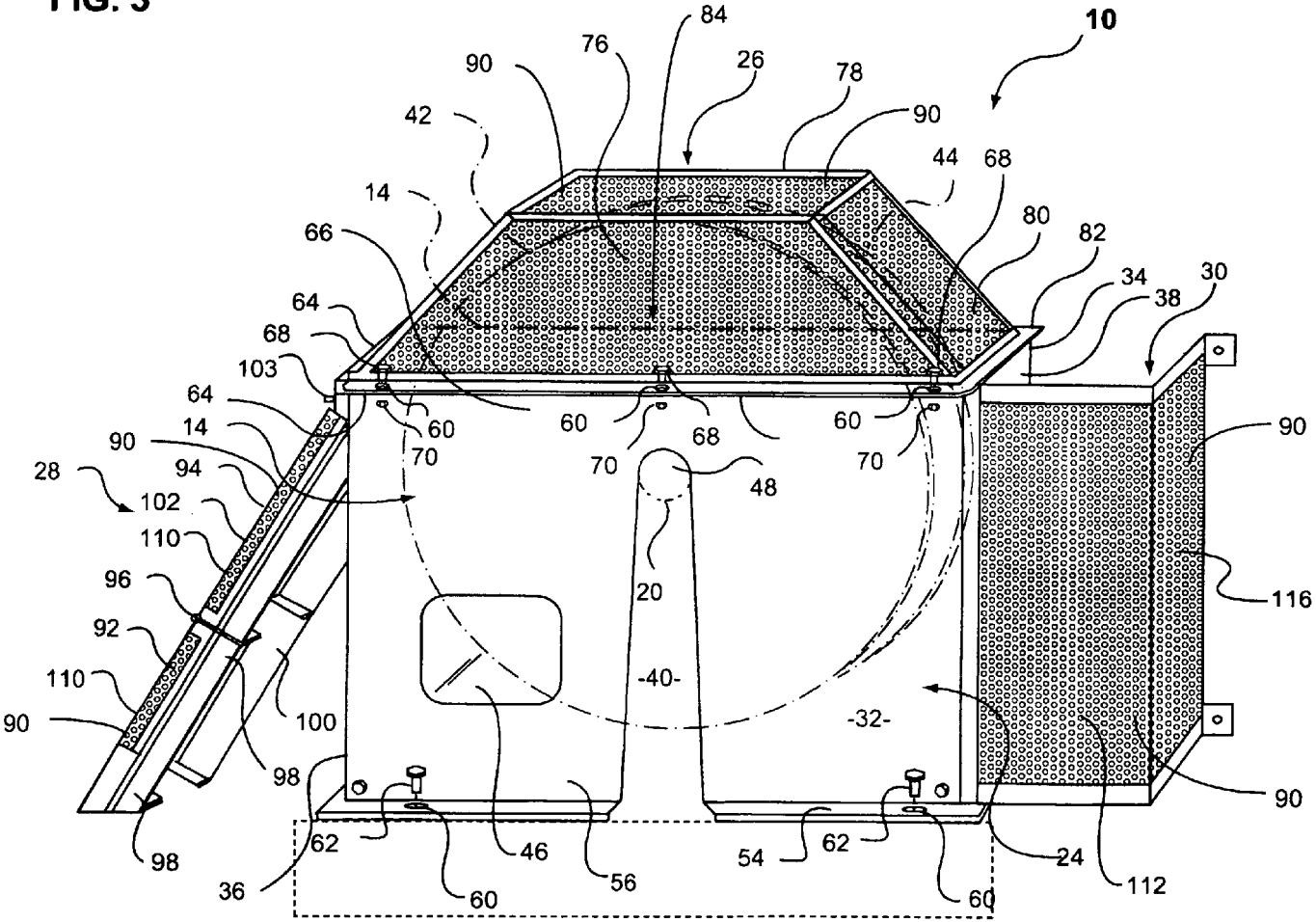
FIG. 3 is front perspective view of a safety guard apparatus for an elevator machine according to an embodiment of the present invention.
Figure 4:
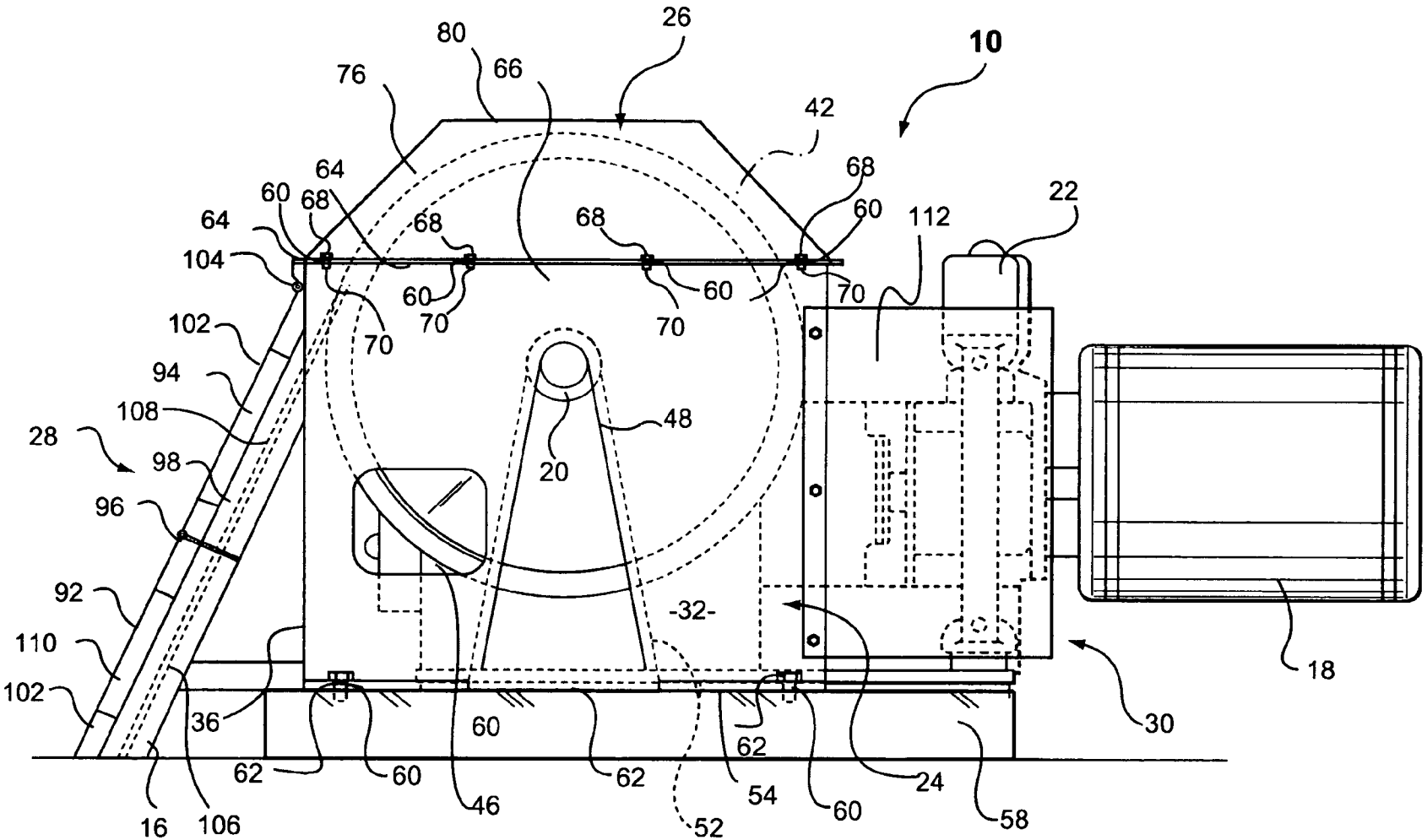
FIG. 4 is a front perspective view of the safety guard apparatus of FIG. 3 positioned around an elevator machine.
Figure 5:
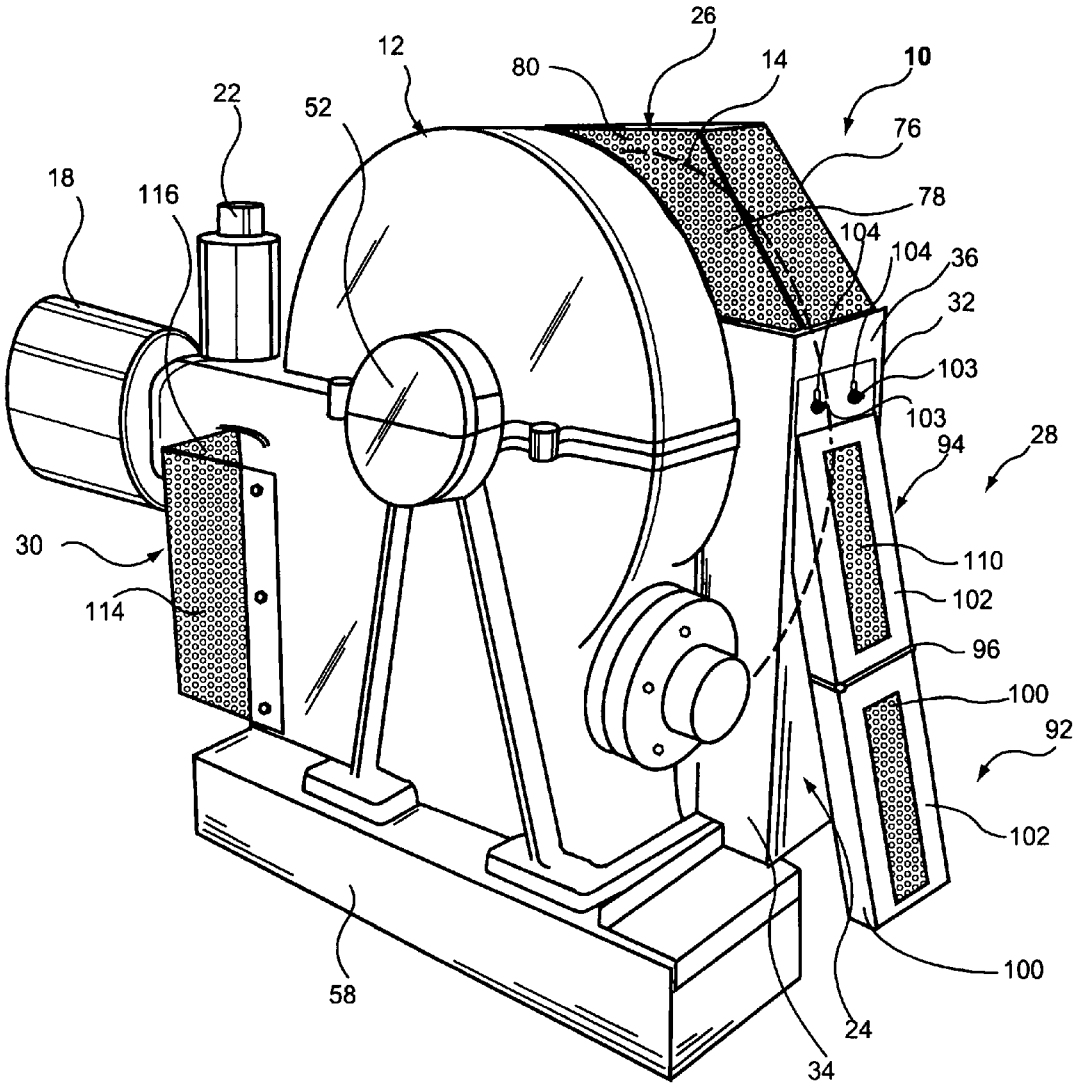
FIG. 5 is a rear perspective view of the safety guard apparatus of FIG. 3 positioned around an elevator machine.
Figure 8:
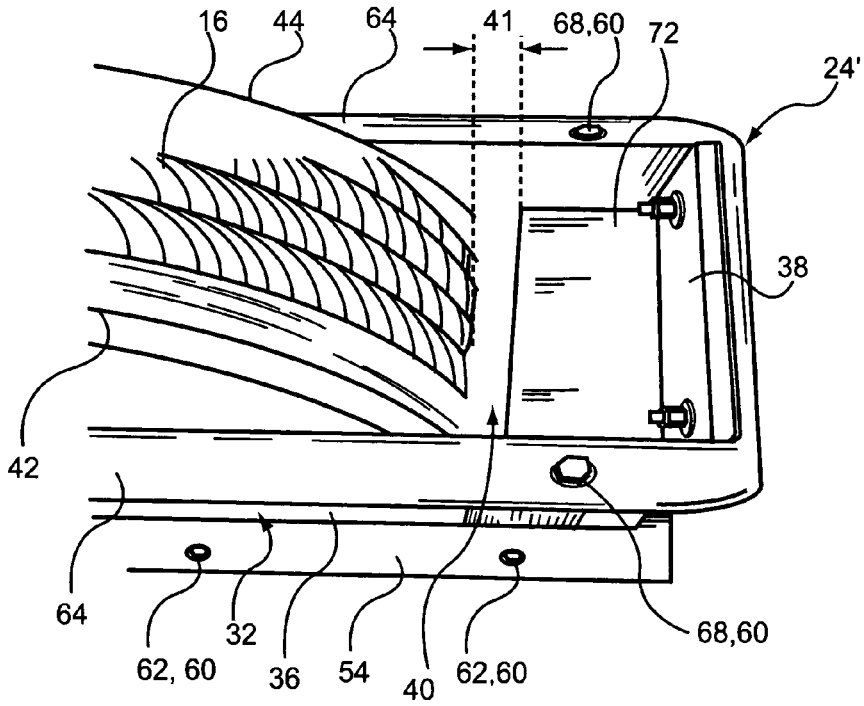
FIG. 8 is a top perspective view of the sheave guard of the safety guard apparatus of FIG. 3 showing the safety flange.
Figure 9:
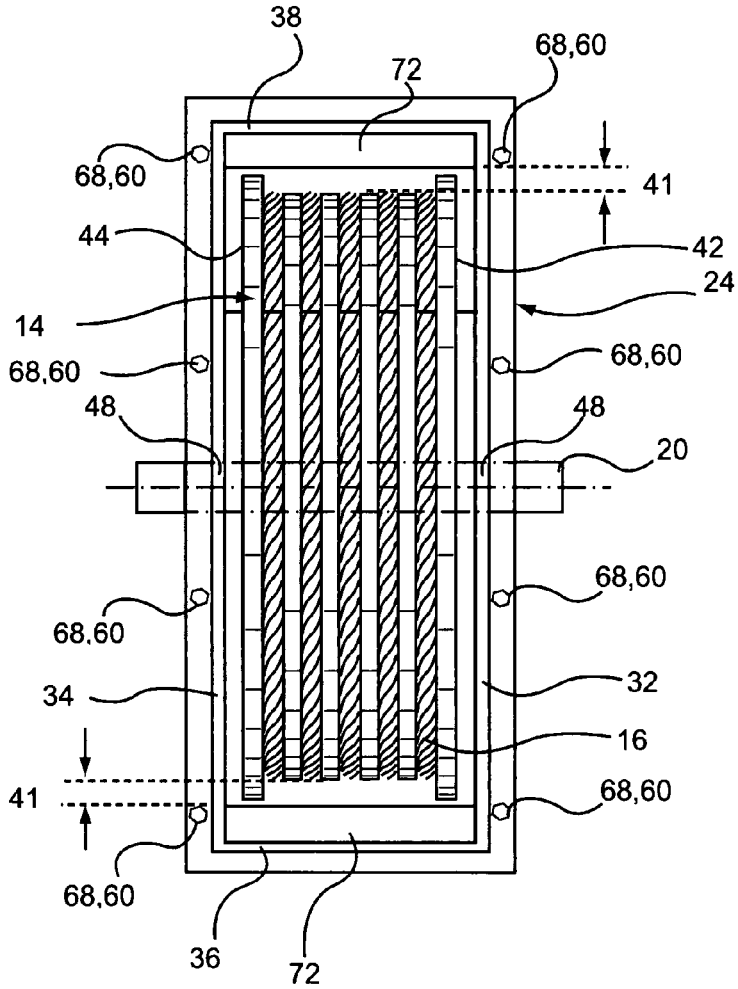
FIG. 9 is a top plan view of the sheave guard of the safety guard apparatus of FIG. 3.
Figure 10:
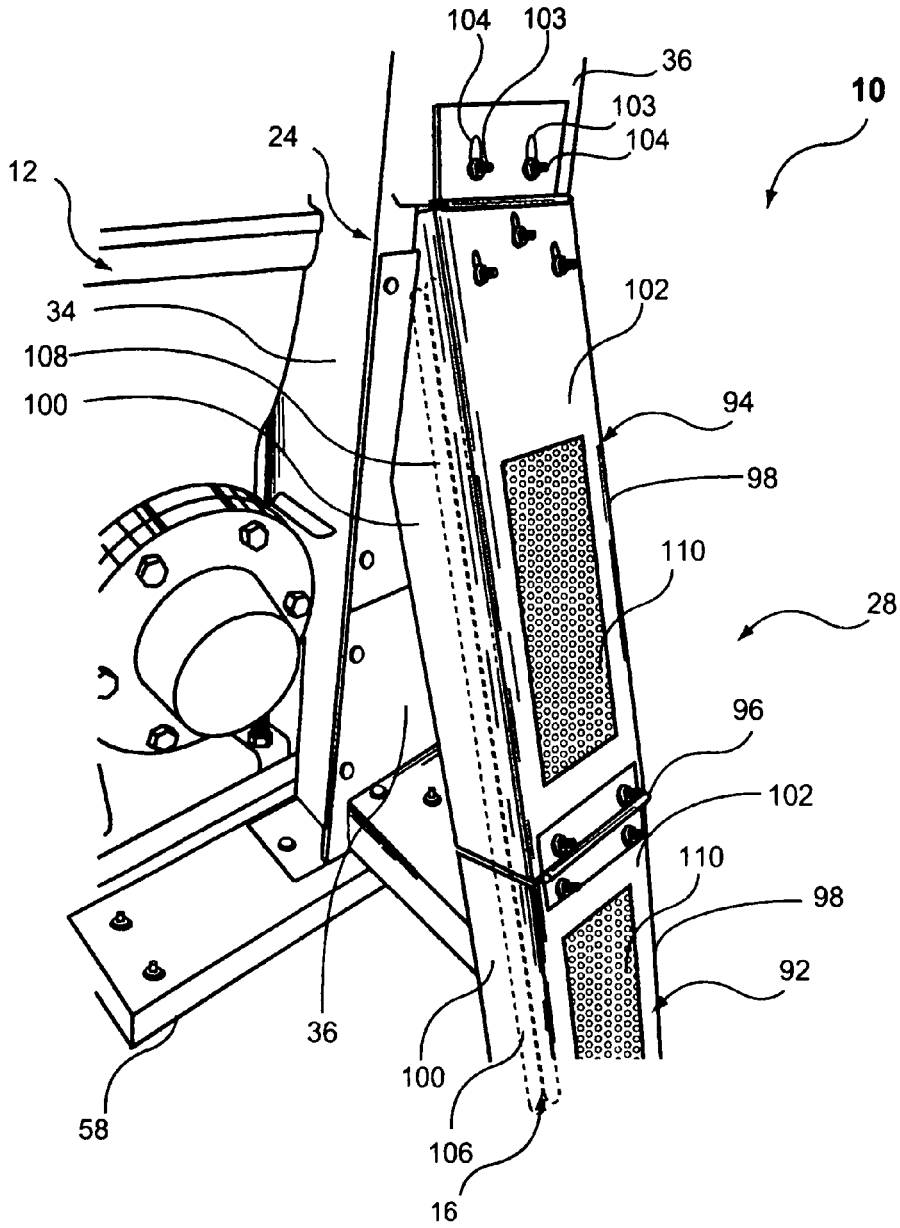
FIG. 10 is a rear perspective view of the hoist rope guard of the safety guard apparatus of FIG. 3.
Figure 11:
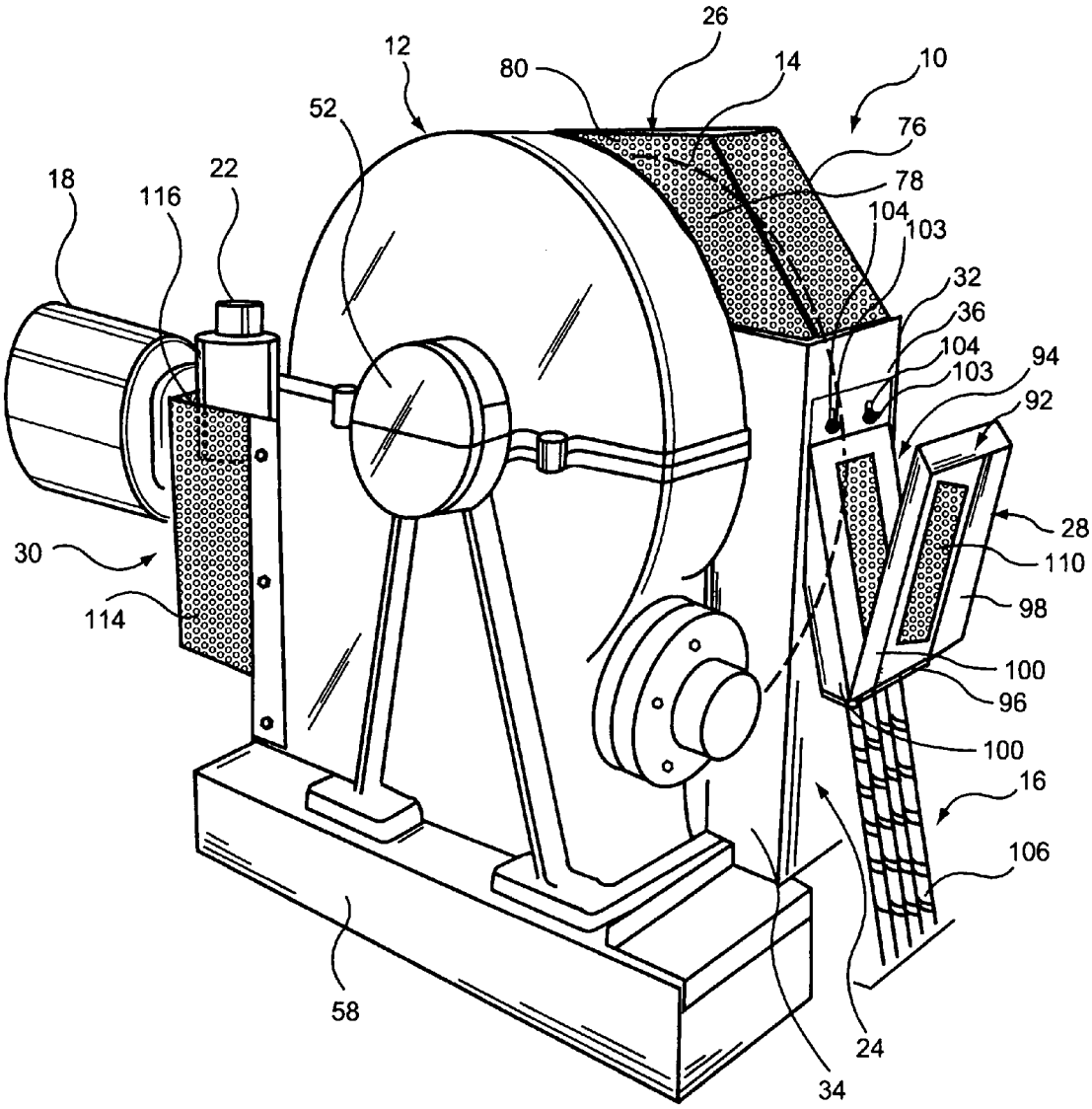
FIG. 11 is a rear perspective view of the hoist rope guard of the safety guard apparatus of FIG. 3 showing the lower portion pivotally opened.
Figure 12:
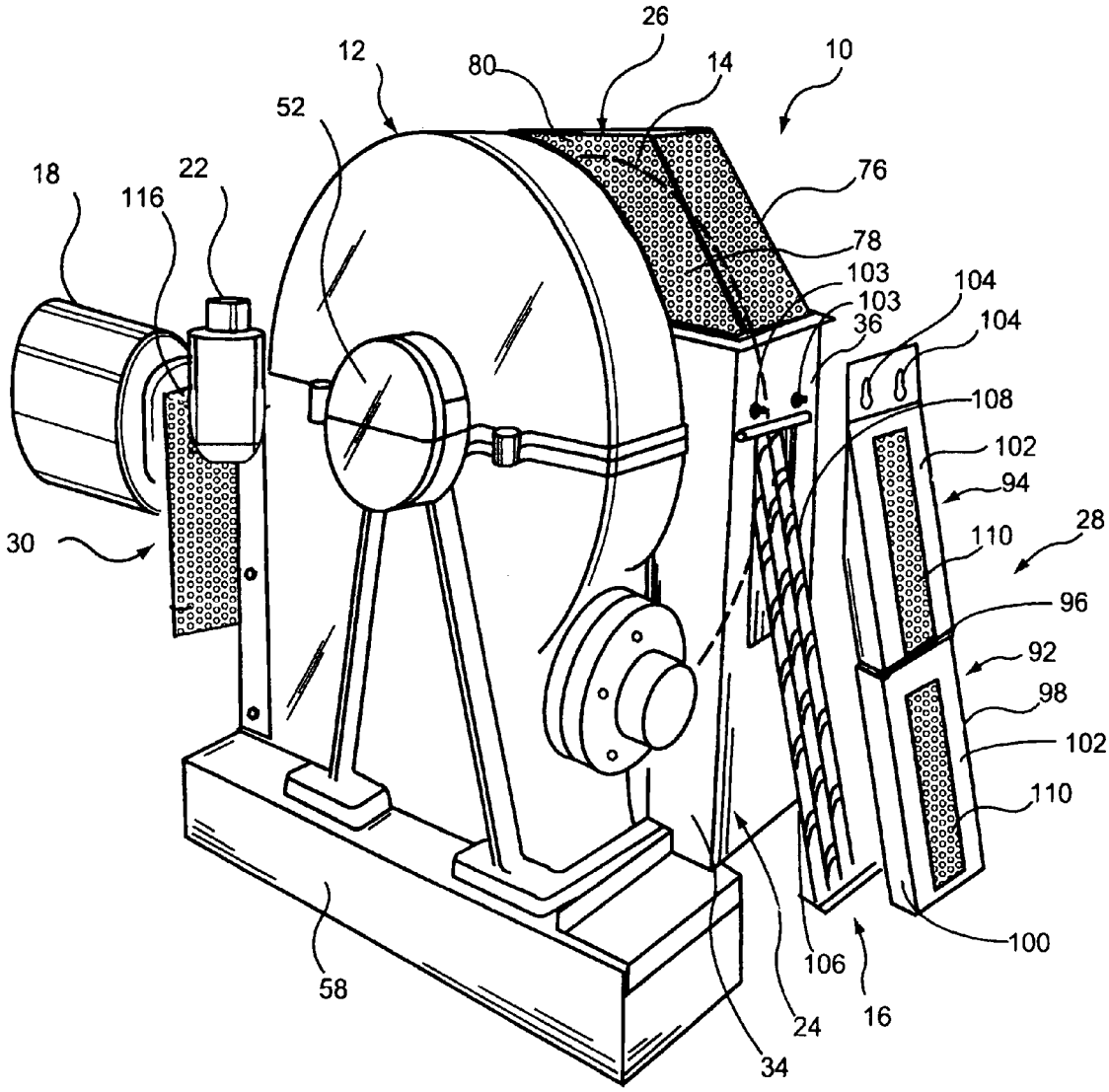
FIG. 12 is a rear perspective view of the hoist rope guard of the safety guard apparatus of FIG. 3 raised and removed from the side sheave wall.

Referring to FIGS. 3, 4, 5 and 6, the safety guard apparatus 10 of the present invention is comprised of a sheave guard 24, a cover guard 26, a hoist rope guard 28 and a brake guard 30 which are releasably secured together to substantially enclose the sheave 14 and machine brake 22 of the elevator machine 12 and at least a portion of the hoist ropes 16 extending from the sheave 14 as shown in FIGS. 4 and 5. Each of these guards may be integrally or modularly formed together to provide a unitary safety guard apparatus 10 depending upon the design specifications of the elevator machine 12 and any particular requirements of local authorities and the like. Referring to FIGS. 3 and 4, the sheave guard 24 includes a front sheave wall 32, a back sheave wall 34 and a pair of oppositely disposed side sheave walls 36 and 38 forming a generally rectangular structure. The sheave guard 24 has an interior space 40 defined by the front, back and side sheave walls 32, 34, 36 and 38. The sheave guard 24 is adapted for positioning around the elevator machine 12 and substantially enclosing the sheave 14 as shown in FIG. 4. As the hoist ropes extending from the sheave 14 form pinch or nip spaces 41 into which service personnel may become entangled, the height of the front, back and oppositely disposed side sheave walls 32, 34, 36 and 38 is sufficient to conceal these nip spaces (as shown in FIGS. 8 and 9). By this design, the sheave guard is positioned around the sheave and at least a portion of the hoist ropes 16. The front sheave wall 32 is positioned adjacent to a front surface 42 of the sheave 14. The back sheave wall 34 is positioned adjacent to a back surface 44 of the sheave 14 and spaced apart from the front sheave wall 32. The pair of side sheave walls 36 and 38 extend between the front and back sheave walls 32 and 34. The front sheave wall 32 may be provided with an observation window 46 to facilitate the viewing of the sheave 14 and the hoist ropes 16 from a different perspective or vantage point.

Each of the front and back sheave walls 32 and 34 are provided with a corresponding axle slot 48 which are dimensioned to receive at least a portion of the axle 20 extending from the motor 18 of the elevator machine 12 to an axle bearing stand 52. The provision of the axle slots 48 enables the front and back sheave walls 32 and 34 to be positioned around and in close proximity to the sheave 14 and, as a result, minimizes the additional space that may be required to facilitate the positioning of the safety guard apparatus 10 adjacent to the elevator machine 12. The side sheave wall 36 is formed with a hoist rope aperture 50 for receiving the one or more hoist ropes 16 extending from the sheave 14. The sheave guard 24 may be manufactured from any suitable solid sheet-like material such as, for example, steel or high-density plastic. Preferably, the sheave guard 24 is formed from a 16 gauge solid sheet steel material.

Referring to FIGS. 3 and 4, each of the front, back and side sheave walls 32, 34, 36 and 38 have a lower sheave flange 54 extending around a bottom edge 56 of the sheave guard 24 for enabling the sheave guard 24 to be secured to a base surface 58 adjacent to the elevator machine 12. The lower sheave flange 54 is drilled, punched or otherwise supplied with a plurality of mounting holes 60 through which a plurality of mounting bolts 62 are inserted and secured within the base surface 58. It should be understood by a person skilled in the art of the present invention that the lower sheave flange 54 may alternatively be employed to enable the sheave guard 24 to be secured to the elevator machine 12 directly. The front, back and side sheave walls 32, 34, 36 and 38 are also provided with an upper sheave flange 64 extending around a top edge 66 of the sheave guard 24 to enable the cover guard 26 to be releasably secured to the sheave guard 24. Similarly, the upper sheave flange 64 is drilled, punched or otherwise supplied with a plurality of mounting holes (such as the mounting holes 60), through which a plurality of securing bolts 68 are inserted and releasably secured to a plurality of corresponding securing nuts 70.

Figure 6:
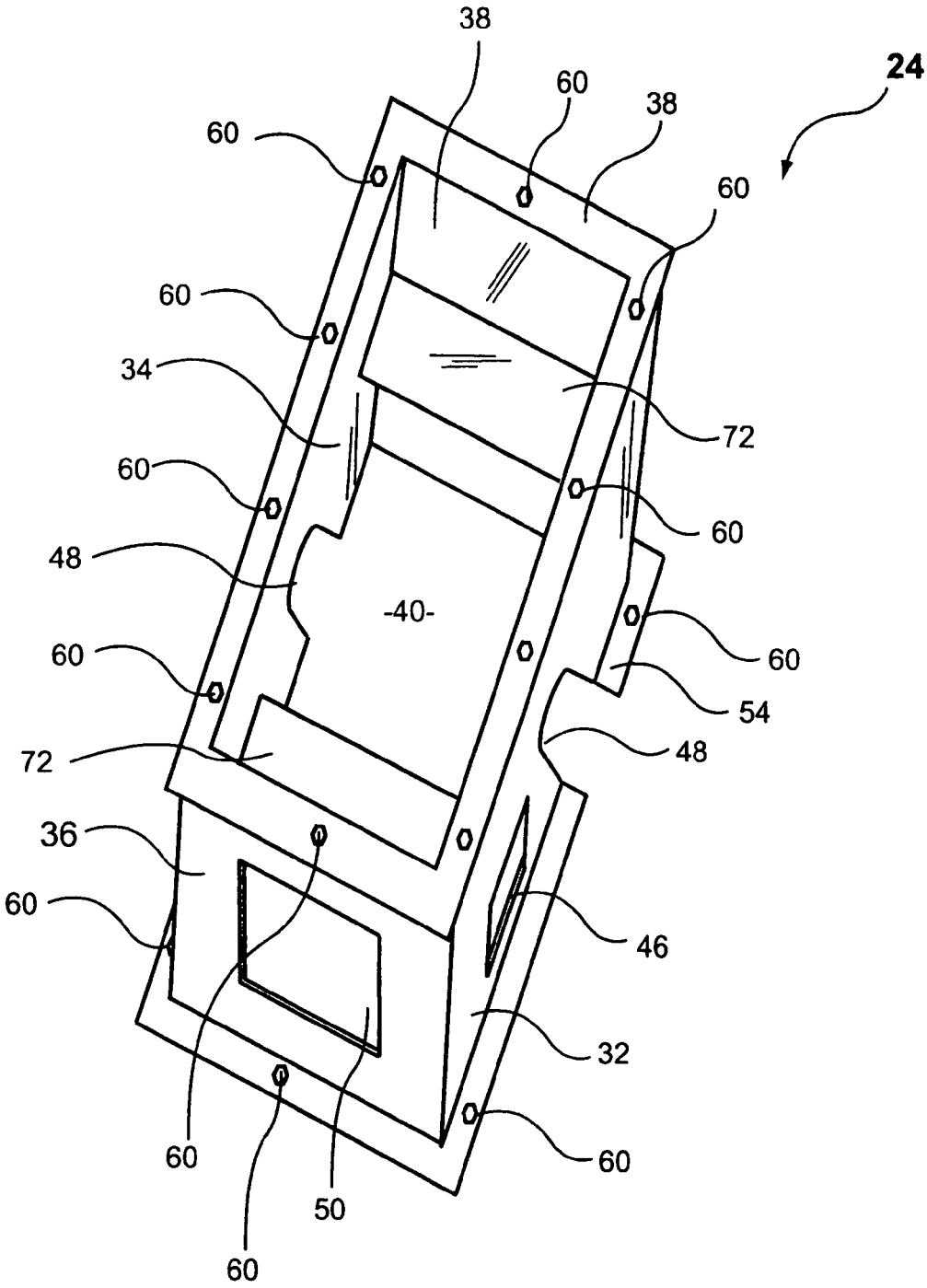
FIG. 6 is top perspective view of the sheave guard of the safety guard apparatus of the present invention.
Figure 7:
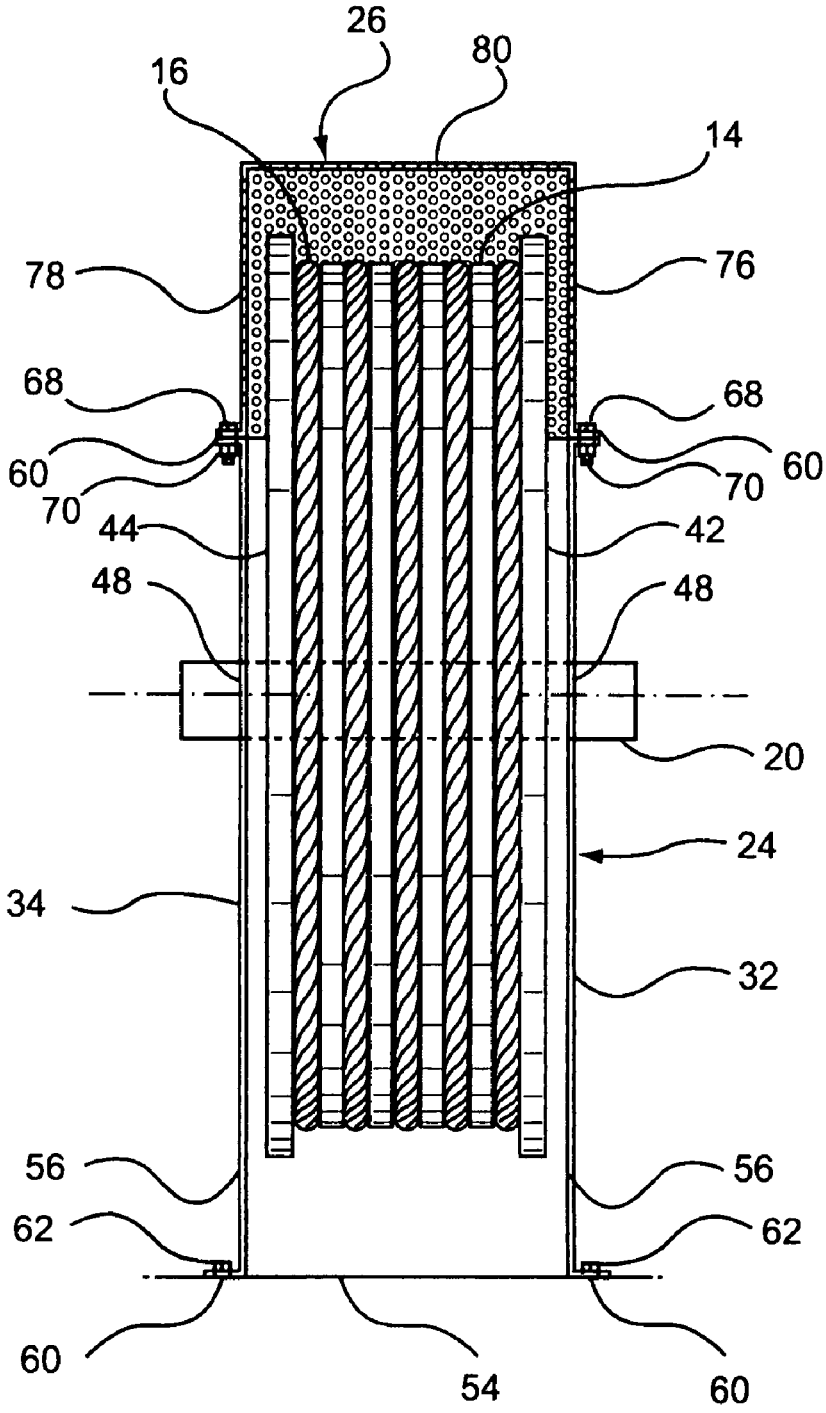
FIG. 7 is a side cross-sectional view of a sheave guard of the safety guard apparatus of FIG. 3 positioned around a sheave.

In an embodiment of the sheave guard 24 shown in FIGS. 6, 8 and 9, the sheave guard 24 is formed with a safety flange 72 extending from the side sheave walls 36 and 38 interiorly towards the sheave 14. The safety flange 72 is adapted to minimize the size of the nip spaces 41 between the sheave 14, the hoist ropes 16 extending around the sheave 14 and the side sheave walls 36 and 38 of the sheave guard 24. By minimizing the size of the nip spaces 41 within the interior space 40 of the sheave guard 24, the likelihood of service personnel becoming entangled between the sheave 14, the hoist ropes 16 and/or sheave guard 24 while inspecting the rotating sheave 14 or adjusting the speed of the motor 18 using a tachometer, for example, is significantly reduced. It should be understood by those skilled in the field of the present invention that the safety flange 72 may be dimensioned to form any suitably sized nip space 41.

Referring to FIGS. 3 and 9, the cover guard 26 is pivotally secured to the sheave guard 24 for pivotally opening and providing access to at least a portion of the sheave 14 and the one or more hoist ropes 16. When secured to the sheave guard 24, the cover guard 26 is adapted to enable the viewing of at least a portion of the sheave 14 and the hoist ropes 16 from outside of the safety guard apparatus 10. The cover guard 26 and the sheave guard 24 completely enclose the sheave 14 of the elevator machine 12 when secured together. As shown in FIG. 3, the cover guard 26 has a front cover wall 76, a back cover wall 78 and a top cover wall 80 extending between the front and back cover walls 76 and 78. The front cover wall 76 is positioned adjacent to a front surface 42 of the sheave 14. The back cover wall 78 is positioned adjacent to a back surface 44 of the sheave 14 and is spaced apart from the front cover wall 76. The front, back and top cover walls 76, 78 and 80 are provided with a cover flange 82 extending around a lower edge 84 of the cover guard 26 for enabling the cover guard 26 to be releasably secured to the sheave guard 24. The cover flange 82 is drilled, punched or otherwise supplied with a plurality of mounting holes (such as the cover mounting holes 60) that correspond and align with the plurality of cover mounting holes 60 provided in the upper sheave flange 64 of the sheave guard 24. The plurality of mounting bolts 62 are inserted and releasably secured in the cover mounting holes 60 to the plurality of corresponding securing nuts 68.

Although in the embodiment shown in FIG. 3 the cover guard 26 has a generally trapezoidal design, it should be understood by those skilled in the field of the present invention that the cover guard 26 may have any suitable design which does not interfere with the operation of the elevator machine 12, and particularly the rotational movement of the sheave 14 and the hoist ropes 16. The cover guard 26 is formed from a sheet material having a plurality of openings 90 through which service personnel may view the operation and condition of the sheave 14 and the hoist ropes 16 from outside the safety guard apparatus 10. The sheet material may be any suitable material including steel mesh, perforated steel, transparent plastic or Plexiglass®, for example. Preferably, the sheet material is a 16 gauge perforated steel mesh material designed to reject at least a ¼" diameter ball. By this design, the size of the openings 90 in the steel mesh material will enable the elevator service personnel to visually inspect the sheave 14 without having to unsecure the cover guard 26 from the sheave guard 24. In the event that regular maintenance or repair to the sheave 14 or the hoist ropes 16 is required, the cover guard 30 may be removed from the sheave guard 24 to allow access to at least a portion of the sheave 14 and hoist ropes 16 (as shown in FIGS. 8 and 9).

Referring to FIGS. 3, 10, 11 and 12, the hoist rope guard 28 has a lower portion 92 pivotally coupled to an upper portion 94 using a first hinge 96 for substantially enclosing the one or more hoist ropes 16 extending from the sheave 14 of the elevator machine 12. The lower and upper portions 92 and 94 together define a front rope guard wall 98, a back rope guard wall 100 and a side rope guard wall 102 extending between the front and back rope guard walls 98 and 100. The side rope guard wall 102 of the upper portion 94 of the hoist rope guard 28 is pivotally secured to the side sheave wall 36 of the sheave guard 24 using one or more key slots 104 on the side rope guard wall 102 which align with one or more corresponding fasteners 103 on the side sheave wall 36. The lower portion 92 of the hoist rope guard 28 may be releasably secured to the base surface 58 using one or more mounting bolts (such as the mounting bolts 62). The first hinge 96 is adaptable for enabling the lower portion 92 to pivotally open relative to the upper portion 94 for providing access to a lower segment 106 of the one or more hoist ropes 16. Similarly, the upper portion 94 may be pivotally opened relative to the lower portion 92 about the first hinge 96 to provide access to an upper segment 108 of the one or more hoist ropes 16. The key slots 104 and the fasteners 103 are adaptable for enabling the lower and upper portions 92 and 94 of the hoist rope guard 28 to be raised and removed from the side sheave wall 36 of the sheave guard 24 to provide access to both the lower and upper segments 106 and 108 of the one or more hoist ropes 16.

Each of the lower and upper portions 92 and 94 of the hoist rope guard 28 are formed with a viewing window 110 to enable the viewing of the operation and condition of the hoist ropes 16 extending from the sheave 14 from outside of the safety guard apparatus 10. The viewing windows 110 are manufactured from any suitable sheet material, such as steel mesh, perforated steel, transparent plastic or Plexiglas®, having a plurality of openings 90 for enabling service personnel to view the one or more hoist ropes 16 through the viewing window. Preferably, the viewing windows 110 of the hoist rope guard 28 are manufactured from at least a 16 gauge perforated steel mesh material designed to reject at least a ¼" diameter ball. Apart from the viewing windows 110, the lower and upper portions 92 and 94 of the hoist rope guard 24 may be manufactured from any suitable solid sheet-like material such as, for example, steel or high-density plastic. Preferably, the sheave guard 24 is formed from a 16 gauge solid sheet steel material.

Figure 13:
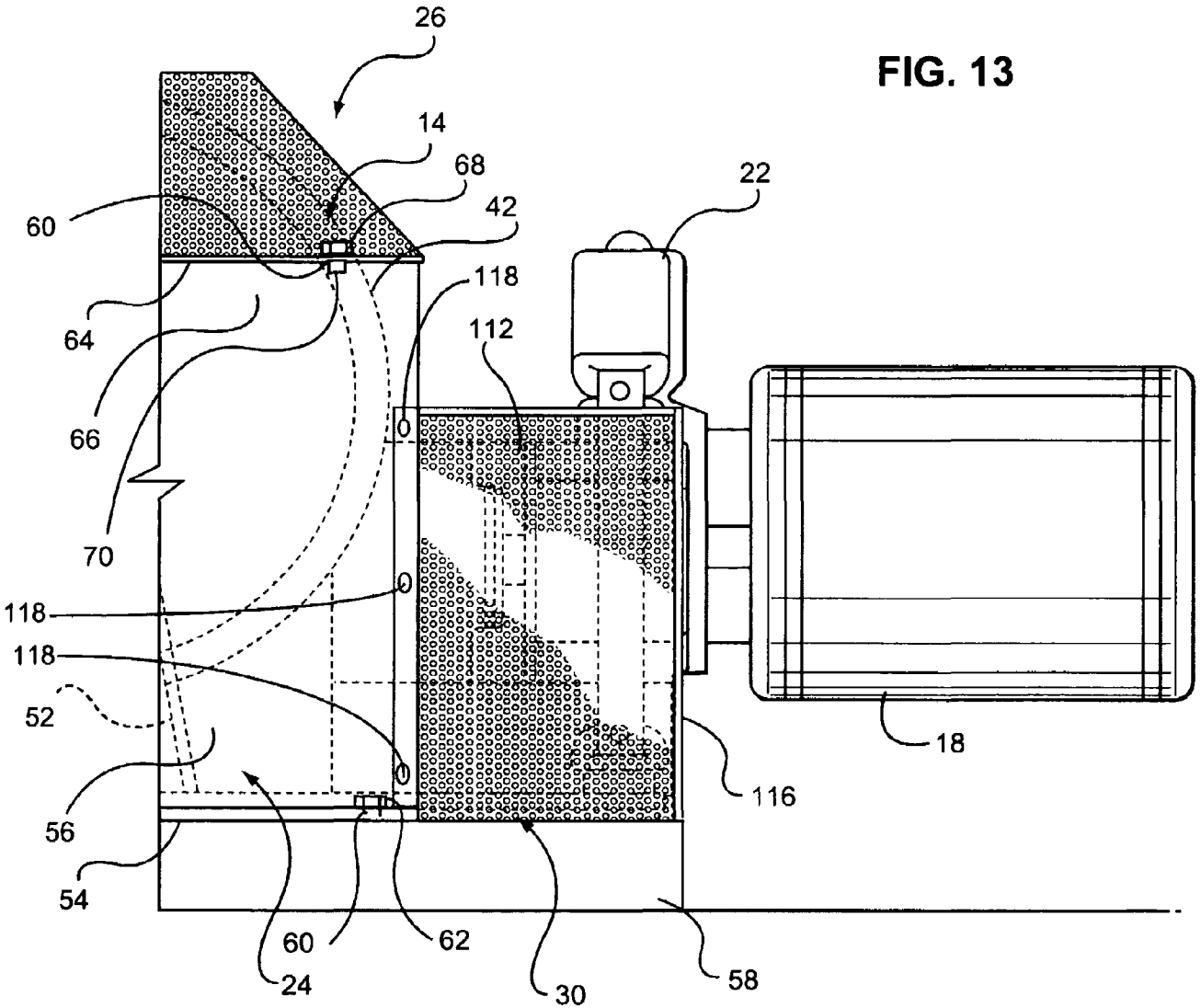
FIG. 13 is a front elevation view of the brake guard of the safety guard apparatus of FIG. 3.

Referring to FIGS. 3, 5 and 13, the brake guard 30 is adaptable for positioning around the machine brake 22 of the elevator machine 12 and includes a front brake wall 112 and a side brake wall 116 extending from the front brake walls 112. The front brake wall 112 is drilled, punched or otherwise supplied with one or more brake guard mounting holes 118 through which mounting bolts (such as the securing bolts 62) are inserted and releaseably secured in the front sheave wall 32 of the sheave guard 14. In order to facilitate the visual inspection of the machine brake 22 by service personnel, the brake guard 30 may be manufactured from any suitable sheet material, such as steel mesh, perforated steel, transparent plastic or Plexiglas®. Preferably, the brake guard 30 is manufactured from a 16 gauge perforated steel mesh material designed to reject at least a ¼" diameter ball.

It should be understood that the safety guard apparatus 10 of the present invention may be coated with a luminescent material, such as orange or yellow paint, to provide a visual indication to the service personnel that the dangerous mechanical components of the elevator machine 12 are being concealed by the safety guard apparatus 10. Moreover, the safety guard apparatus 10 may be provided with one or more signage plates (not shown) which provide the service personnel with warnings and instructions on gaining safe access to the mechanical components of the elevator machine 12.

In use, the safety guard apparatus 10 of the present invention is designed to be positioned substantially around the sheave 14, machine brake 22 and at least a portion of the hoist ropes 16 of the elevator machine 12 to minimize the likelihood of service personnel becoming accidentally entrapped or otherwise injured by the movement of the sheave 14, machine brake 22 and/or hoist ropes 16. Each of the sheave guard 24, cover guard 26, hoist rope guard 28 and brake guard 30 may be partially manufactured from perforated sheet or transparent materials to enable service personnel to safely view the operation and condition of the sheave 14, machine brake 22 and at least a portion of the hoist ropes 16 from outside of the safety guard apparatus 10. When servicing is required to maintain the regular operation of the elevator machine 12, each of the sheave guard 24, cover guard 26, hoist rope guard 28 and brake guard 30 may be independently opened or removed to provide access to the desired component of the elevator machine 12. Alternatively, the cover and hoist rope guards 26 and 28 may be pivotally opened to provide service personnel with access to the sheave 14 and hoist ropes 16.

While what has been shown and described herein constitutes a preferred embodiment of the subject invention, it should be understood that various modifications and adaptions of such embodiment can be made without departing from the present invention, the scope of which is defined in the appended claims.

The invention claimed is:

1. A safety guard apparatus for an elevator machine having a brake and a sheave for engaging one or more hoist ropes rotatably driven by the elevator machine, the safety guard apparatus comprising:

a sheave guard including a front sheave wall, a back sheave wall and a pair of oppositely disposed side sheave walls defining a generally rectangular structure adapted for substantially enclosing the sheave of the elevator machine;

wherein each of the pair of oppositely disposed side sheave walls include a safety flange extending interiorly towards the sheave; and, a cover guard releasably secured to the sheave guard and including a top cover wall and a pair of oppositely disposed cover side walls through which the one or more hoist ropes and the sheave can be viewed.

2. The safety guard apparatus as claimed in claim 1, wherein the pair of oppositely disposed side sheave walls define a top sheave flange, and wherein top cover guard defines a bottom cover flange.

3. The safety guard apparatus as claimed in claim 2, wherein the bottom cover flange of the cover guard is releasably secured to the top sheave flange of the sheave guard with one or more fasteners.

4. The safety guard apparatus as claimed in claim 2, wherein the front sheave wall, the back sheave wall and the pair of oppositely disposed side sheave walls define an interior space.

5. The safety guard apparatus as claimed in claim 1, further comprising a hoist rope guard releaseably secured to at least one of the pair of oppositely disposed side sheave walls of the sheave guard, wherein the hoist rope guard includes a lower rope guard portion pivotally coupled to a upper rope guard portion for substantially enclosing the one or more hoist ropes extending from the sheave.

6. The safety guard apparatus as claimed in claim 5, wherein the first and second rope guard portions together define a top hoist rope wall and a pair of oppositely disposed side hoist rope walls.

7. The safety guard apparatus as claimed in claim 5, wherein the lower portion is adaptable for pivotally opening relative to the upper portion for providing access to the one or more hoist ropes.

8. The safety guard apparatus as claimed in claim 5, including a hinge connecting said upper and lower rope guard portions for pivotally opening of one said portion relative to the other portion for providing access to the one or more hoist ropes.

9. The safety guard apparatus as claimed in claim 5, wherein at least a portion of the lower portion and the upper portion of the hoist rope guard is manufactured from a perforated sheet material through which the one or more hoist ropes can be viewed.

10. The safety guard apparatus as claimed in claim 9, wherein the perforated sheet material is a steel material.

11. The safety guard apparatus as claimed in claim 5, wherein at least a portion of the lower portion and the upper portion of the hoist rope guard is manufactured from a transparent material through which the one or more hoist ropes can be viewed.

12. The safety guard apparatus as claimed in claim 1, further comprising a brake guard including a front brake wall and a side brake wall extending from the front brake wall for substantially enclosing the brake of the elevator machine.

13. The safety guard apparatus as claimed in claim 12, wherein at least a portion of the brake guard is manufactured from a perforated sheet material through which the brake can be viewed.

14. The safety guard apparatus as claimed in claim 13, wherein at least a portion of the perforated sheet materials is metal.

* * * * *